United States Patent [19]

Stephenson et al.

[11] Patent Number: 4,676,387

[45] Date of Patent: Jun. 30, 1987

[54] NURSING BOTTLE FOR INFANTS

[76] Inventors: Jim D. Stephenson, 8474 Darlene La., Canoga Park, Calif. 91304; Paul C. Donner, 3331 Barnes St., Simi Valley, Calif. 93063

[21] Appl. No.: 924,814

[22] Filed: Oct. 30, 1986

Related U.S. Application Data

[63] Continuation of Ser. No. 837,838, Mar. 10, 1986.

[51] Int. Cl.[4] ..... A61J 9/00

[52] U.S. Cl. ..... 215/11 R

[58] Field of Search ..... 215/11 R; D9/373; D24/47

[56] References Cited

U.S. PATENT DOCUMENTS

| | | | |
|---|---|---|---|
| D. 249,076 | 8/1978 | Meeker et al. | D24/47 X |
| 253,014 | 1/1882 | Day | 215/11 R |
| 446,116 | 2/1891 | Monroe | 215/11 R |
| 2,469,489 | 5/1949 | Allen et al. | 215/11 R |
| 2,514,744 | 7/1950 | Cipyak | 215/11 R |
| 3,145,867 | 8/1964 | Roberts et al. | 215/11 R |

*Primary Examiner*—Donald F. Norton

*Attorney, Agent, or Firm*—Evanns & Walsh

[57] ABSTRACT

An improved nursing bottle for infants is disclosed. The bottle has an angular configuration having an upper part which is disposed at an angle to the lower part of the bottle. The angle between the two parts is between the top end of the bottle and the middle or center part of the bottle. The top end of the bottle has a fitting including a nipple. The angular configuration of the bottle accommodates it to unique capabilities, either when an infant is lying down and nursing or in a sitting posture.

6 Claims, 4 Drawing Figures

NURSING BOTTLE FOR INFANTS

This is a continuation of application Ser. No. 06/837,838, filed on Mar. 10, 1986.

BACKGROUND OF THE INVENTION

1. Field of the Invention

The field of the invention is that of nursing bottles for infants.

2. Description of the Prior Art

With respect to known prior art, reference is made to U.S. Pat. Nos. 357,439; 484,811; 1,056,113; 2,514,744; 3,145,867; and Des. 249,076.

The devices of the prior art are subject to certain deficiencies and drawbacks constituting problems which have not been met and for which a solution has been needed. The prior art lacks capabilities and advantages to be identified hereinafter.

Typically, in the nursing of human infants, the nursing bottle may be held in hand of a person, such as the mother, or in fact, may be held in the hands of the infant itself. In either situation, there are disadvantages, whether the nipple at the end of the bottle is axially aligned with the axis of the bottle or whether the bottle has a neck carrying the nipple, the axis of which is inclined relative to axis of the body of the bottle.

If the infant is in a lying down position and holding the bottle itself, typically the body of the bottle has to be held in an inclined position upwardly from the infant's body in order for gravity to cause the contents of the bottle to feed to the nipple and to accommodate the position of the nipple to the infant's mouth. This is disadvantageous from the standpoint of being fatiguing for the infant or because of the inability of the infant to hold it in position.

The disadvantage just referred to is further aggravated in situations where an infant is in a sitting position, such as in a high chair, and whether the infant is holding the bottle itself or it is being held by another person. In either situation, it is difficult to hold the bottle in a proper feeding position, and it is tiring and fatiguing in either event, whether held by the infant or another person.

In either of the situations referred to, the drawback is present that the infant may take in an excessive amount of air while sucking the milk through the nipple. This can result from the position of the bottle and the level of milk in the bottle which may drop low enough so as to allow air, as well as milk, to enter through the nipple into the infant's mouth. That is, while the infant is nursing, the level in the bottle of course will drop, and then depending on the actual position of the bottle, the infant may be taking in air through the nipple, as well as milk.

It is particularly significant that when the infant is being nursed in a sitting position, such as in the lap of an adult or in a highchair, typically it is necessary that the baby's head be thrown back in order to accommodate the position of the nipple to the infant's mouth. This is a stressful position for the muscles of the infant's throat and neck and may present difficulty to the infant in swallowing.

The foregoing referred-to drawbacks and disadvantages of prior art nursing bottles have not been met in the prior art, and it is the object of the invention herein, a preferred form of which is described in detail hereinafter, to overcome the said disadvantages and drawbacks and to provide significant capabilities not previously available.

SUMMARY OF THE INVENTION

In a preferred form, the nursing bottle of the herein invention can be made of glass, for example, and may have a uniform diameter from bottom to top. At the top or upper end, it is configured to receive a standard nursing nipple which may be of a type that engages the nursing bottle in threaded relationship, or it may be of a type that is attached by friction.

The nursing bottle of the invention has a unique configuration. In a preferred form, the body of the nursing bottle is circular and may be of uniform diameter from top to bottom, although these characteristics are not critical to the bottle.

The bottle is characterized in that the bottle has an angular conformation in it, that is, an end part, that is, the upper part, of the bottle is conformed to be at an angle with the lower part of the bottle, that is, referring to the axes of the lower part and the inclined upper part, the axis of the upper part is inclined at an angle to the axis of the lower part. In a preferred form of the invention, this angle may be as illustrated in the drawing in a preferred exemplary form of the invention. The exact angle is not critical but provides the characteristics as described herein.

The angle between the top part of the body of the bottle and the lower part may be referred to as a bend in the bottle, and the character of this bend is that the bend constitutes a circular bend which is between a normal to the axis of the lower or longer part of the body and a normal to the axis of the upper part of the body. The exact angular position of the circular bend is not critical.

In light of the foregoing, a primary object of the invention is to provide an improved nursing bottle for infants which is characterized in the bottle has a bend in it, that is, the bottle is angular, having an upper end part having an axis which is positioned at an angle to the central axis of the lower part of the body.

A further object is to provide a nursing bottle as in the foregoing which is capable of being usable in positions which adapt to, and are advantageous relative to, the position of the infant while nursing, whether the infant is lying down or being held in a sitting position.

Another object of the invention is to realize a nursing bottle as in the foregoing and which is favorably adapted to have the center of gravity of the bottle and its contents positioned to accommodate utilization of the bottle, whether the infant being nursed is lying down or is in a sitting position.

DESCRIPTION OF A PREFERRED EMBODIMENT AND BEST MODE OF PRACTICE

Figure 1:
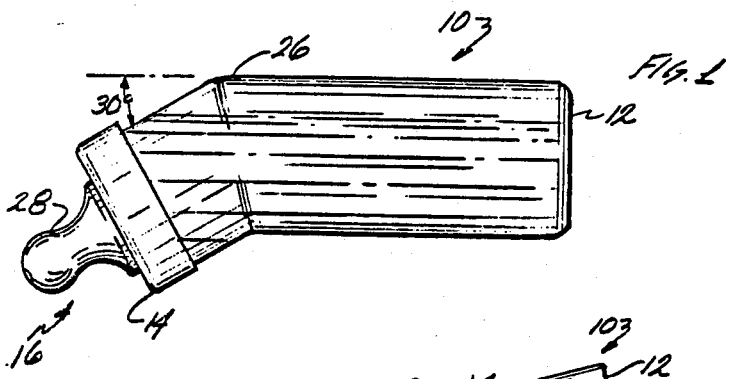
FIG. 1 is an elevational view of a preferred form of the invention.
Figure 2:
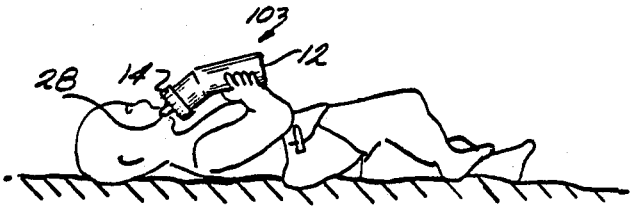
FIG. 2 is a pictorial view illustrating utilization of the form of the invention shown in FIG. 1.

Referring to FIG. 1, this figure shows a preferred form of the invention, and FIG. 2 shows its position in usage with an infant lying on its back. The bottle is identified by the numeral 10; preferably, it may be made of glass, having a uniform diameter. It has a bottom end 12 and an upper end 14. At the upper end is a nipple member 16 which may be of typical construction. As shown, it has a circular part which engages the upper end of the bottle 10 in threaded relationship, the nipple having a flexible nipple part 28 which the infant sucks.

At an intermediate part of the bottle, there is an angular bend in it, as identified by the numeral 26. In other words, the axis of the lower part of the body is at an angle to the upper part of the body, which angle is an acute angle which might be, for example, the angle as shown in the drawings.

The bend in the body of the bottle forms a circle around the bottle which, in the form of the invention shown, is identified by the numeral 26, the bend being at an angle to the axis of the main part of the body and also at an angle to the axis of the upper part of the body.

Figure 3:
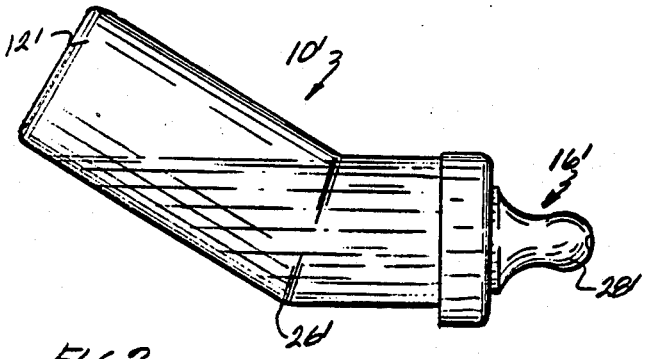
FIG. 3 is a side elevational view of a modified form of the invention wherein the bend in the body of the bottle is at a slightly different position.

Preferably, the angle in the body of the bottle is nearer to the upper end than to the bottom end, and preferably, the position of the angle or bend in the bottle being approximately in the range represented by the forms of the invention shown in FIGS. 1 and 3, or near this range.

FIG. 2 illustrates utilization of the improved bottle as shown in FIG. 1. In this view, the infant is lying on its back and holding the bottle itself. As can be seen, the lower part of the bottle is in a horizontal position. The upper part of the bottle forwardly of the angle in the bottle is in a position to accommodate the nipple to the infant's mouth. As can be seen, the infant does not have to hold the weight of the bottle which can be resting directly on the infant. Thus, the infant is not subjected to the stress and fatigue of having to hold the weight of the bottle, and its head and mouth can remain in a perfectly normal position while the nipple continues to be accommodated to the position of the infant's mouth.

With respect to the level of the liquid, such as milk in the bottle, as can be seen in FIG. 1, the level will continue to cover the entrance to the nipple even while the level diminishes to a relatively low point.

Figure 4:
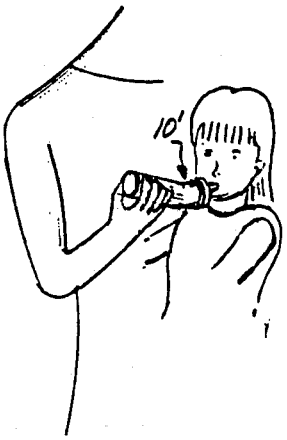
FIG. 4 is a pictorial view illustrating utilization of the form of the invention shown in FIG. 2.

Referring to FIG. 3 of the drawings, this figure shows a slightly modified form of the invention. A manner of utilization of this form of the invention is shown in FIG. 4 The bottle in this form of the invention is identified at 10', and parts that are the same as parts in the previous embodiment are identified by the same reference numerals. The bottle is shown in FIG. 3 in substantially the position it would be in when nursing an infant in a sitting position while being held by an adult as shown in FIG. 4 or while the infant is sitting in a highchair.

In this form of the invention, the bend in the bottle, that is, the angle in it, is spaced slightly further away from the top end of the bottle. The circle represented by the bend in the bottle is identified by the numeral 26'. As in the previous embodiment, this circle representing the bend is between a normal to the axis of the lower part of the body and a normal to the axis of the upper part of the body. In the form of the invention shown, it is in a position spaced farther from the top end of the bottle than it is in FIG. 1.

FIG. 4 illustrates utilization of the bottle of FIG. 3. As may be seen, because of the configuration of the bottle, when nursing the infant does not have to be held at such a steep, that is, acute, angle which would require the infant's head to be thrown backwardly or into a rearward position which is uncomfortable, both to the infant and to the person holding the bottle. Also, the purpose is accomplished that the liquid, such as milk, stays in contact with the entrance to the nipple so that air does not reach the baby's mouth along with the milk. Thus, the need for "burping" the infant after each feeding is eliminated or at least minimized.

From the foregoing, those skilled in the art will readily understand and appreciate the nature and construction of the invention and the manner in which it realizes and accomplishes all of the objects as set forth in the foregoing.

The foregoing disclosure is representative of preferred forms of the invention and is to be interpreted in an illustrative rather than a limiting sense, the invention to be accorded the full scope of the claims appended hereto.

What is claimed is:

1. A nursing bottle adapted for nursing an infant in different positions, the nursing bottle comprising a body having a bottom cylindrical end and a top cylindrical end, the top end having the same diameter as the bottom end and being free of any portion of smaller diameter forming a neck, and having a nursing nipple fitted onto it, the body of the bottle having a configuration including an angle in it, the angle in the body being spaced from the top end of the bottle in an intermediate position between the top end and the bottom end of the bottle, the bottom end of the bottle having an axis and the top end of the bottle having an axis, the said axes forming an angle with each other, the angle in the bottle defining a circle, the said axes intersecting at a point spaced from the top end of the bottle, the portion of the bottle on the top side of said angle having the same size as the portion of the bottle on the lower side of said circle, the bottle being adapted for nursing an infant while the infant is in an upright position or lying down, whereby with the nipple end in a position below the bottom end, the contents reach the entrance to the nipple.

2. A nursing bottle as in claim 1 wherein the body of the bottle is round and has a substantially uniform diameter from the bottom end to the top end, the axis of the nipple coinciding with the axis of the top end of the body between the nipple and said angle.

3. A bottle as in claim 2 wherein the line of demarcation between the angular parts of the bottle is at an intermediate position spaced from the top end but closer to the top end of the bottle than the bottom end.

4. A nursing bottle as in claim 2 wherein the said line of demarcation between the angular parts of the bottle is between the middle of the bottle and the top end, being closer to the middle of the bottle.

5. A nursing bottle adapted for nursing an infant in different positions, the nursing bottle comprising a cylindrical body having a diameter, the body being constructed to have an upper portion, the axis of which is at an angle to the axis of the lower portion, the upper portion having the same diameter as the lower portion, the end of the upper portion having a nursing nipple fitted onto it, the nursing nipple being fitted onto a full diameter of the bottle, the upper portion constituting a substantial portion of the entire bottle, the configuration of the bottle being such that when the bottle is in a position wherein the nursing nipple is at a lower level than the portion on the other side of the angle, the contents of the bottle will flow from the portion on the other side of the angle into the portion of the bottle having the nursing nipple fitted onto it.

6. A nursing bottle as in claim 5 wherein the bottle may be held with either the portion below the angle in a substantially horizontal position or with the portion above the angle in a substantially horizontal position, the nursing nipple being at a lower level than the portion below the angle so that the required amount of tipping of the bottle is reduced.

* * * * *